US008296893B2

(12) United States Patent
Vinci et al.

(10) Patent No.: US 8,296,893 B2
(45) Date of Patent: Oct. 30, 2012

(54) APPARATUS FOR CLEANING FEMALE ELECTRICAL TERMINALS

(76) Inventors: Peter Vinci, Mount Tremper, NY (US); Ian R. Vinci, Shandaken, NY (US)

( * ) Notice: Subject to any disclaimer, the term of this patent is extended or adjusted under 35 U.S.C. 154(b) by 876 days.

(21) Appl. No.: 12/419,956

(22) Filed: Apr. 7, 2009

(65) Prior Publication Data

US 2010/0251496 A1 Oct. 7, 2010

(51) Int. Cl.
*H01R 43/00* (2006.01)

(52) U.S. Cl. ..... 15/104.05; 15/236.01; 15/236.05; 15/236.07; 15/104.001; 451/524; 451/908

(58) Field of Classification Search ..... 15/104.05, 15/104.011, 104.001, 236.01, 236.07, 236.05, 15/236.08; 451/523–525, 908
See application file for complete search history.

(56) References Cited

U.S. PATENT DOCUMENTS

| | | | | |
|---|---|---|---|---|
| 1,497,963 | A * | 6/1924 | Unfried | 7/100 |
| 2,787,010 | A * | 4/1957 | Uphoff | 408/204 |
| 3,504,459 | A * | 4/1970 | Spiteri | 451/525 |
| 4,099,310 | A * | 7/1978 | Mitchell | 407/29.13 |

FOREIGN PATENT DOCUMENTS

| | | |
|---|---|---|
| DE | 1540065 | * 12/1969 |
| EP | 115784 | * 8/1984 |
| FR | 2796499 | * 1/2001 |

OTHER PUBLICATIONS

English translation of DE 1540065, Luz, Dec. 1969 (translation dated Jun. 2012).*

* cited by examiner

*Primary Examiner* — Laura C Guidotti

(74) *Attorney, Agent, or Firm* — Law Offices of Michael L. Wise, LLC

(57) ABSTRACT

An apparatus for cleaning cylindrical female electrical terminals comprises a cylindrical shaft portion, a first cleaning extension, and a second cleaning extension. The first cleaning extension extends outward from the cylindrical shaft portion and comprises a first curved and knurled surface region. Likewise, the second cleaning extension extends outward from the cylindrical shaft portion in a direction substantially parallel to the first cleaning extension and comprises a second curved and knurled surface region. The first cleaning extension and the second cleaning extension define a gap therebetween.

16 Claims, 3 Drawing Sheets

APPARATUS FOR CLEANING FEMALE ELECTRICAL TERMINALS

FIELD OF THE INVENTION

The present invention relates generally to electrical connectors, and, more particularly, to apparatus for cleaning female electrical terminals.

BACKGROUND OF THE INVENTION

Most trailers that are towed by vehicles may be connected to the towing vehicle's electrical system. The towing vehicle's electrical system may operate the trailer's lights and brakes, and may even supply power for electrical appliances on the trailer (e.g., interior lights, refrigerators, and winches). To facilitate the electrical connection, the trailer is usually equipped with a standard "pigtail" electrical connector that couples to a corresponding electrical connector on the towing vehicle. The electrical connector on the towing vehicle may be either original equipment installed by the manufacturer, or an after-market device installed by the consumer.

There are several variations in the types of connector technologies that are used to couple a trailer to the electrical system of its towing vehicle. These include "4-way round" and "4-way flat" connector technologies, "5-way round" and "5-way flat" connector technologies, "6-way round" and "6-way square" connector technologies, and "7-way round, round-pin" and "7-way round, flat-pin" connector technologies. Except for the "7-way round, flat-pin" connector technology, these various technologies utilize a combination of round male electrical pins and cylindrical female electrical terminals to form the various individual electrical connections. FIGS. 1A and 1B, for example, show perspective views of a trailer connector 100 and a towing vehicle connector 110, respectively, in accordance with the "4-way round" connector technology. As can be seen in the figures, the trailer connector comprises a male plug 120 having four cylindrical female electrical terminals 130. The towing vehicle connector, on the other hand, comprises a female socket 140 having four inversely arranged round male electrical pins 150. Each of these four round male electrical pins in the towing vehicle's female socket is inserted into and makes electrical contact with a corresponding cylindrical female electrical terminal in the trailer's male plug when the male plug is correctly inserted into the female socket.

Because of their relationship to safety, it is critical that each electrical contact on the trailer's connector, whether it is a round male electrical pin or a cylindrical female electrical terminal, be capable of forming a low-resistance electrical connection with its corresponding electrical contact on the towing vehicle's connector. Unfortunately, this requirement is made more difficult by the environment in which these connectors operate. Because of their placement in relation to the towing vehicle, these connectors and their electrical contacts are frequently exposed to dirt and moisture. Dirt can coat the electrical contacts, forming a high-resistance surface layer. Moisture, especially when combined with road salt, can corrode the electrical contacts. In an attempt to mitigate these issues, some connectors include covers for protecting their electrical contacts when the connectors are not in use. The towing vehicle connector 110 in FIG. 1B, for example, includes a spring-loaded hatch cover 160. Nevertheless, such covers are often ineffective because of the extreme conditions to which these connectors are exposed. This is true especially for corrosion.

For the foregoing reasons, there is a need for a low-cost apparatus that makes it easy and convenient to clean dirt and corrosion from cylindrical female electrical terminals on trailer connectors as well as other types of connectors so that these electrical terminals are capable of reliably forming low-resistance electrical connections.

SUMMARY OF THE INVENTION

Embodiments of the present invention address the above-identified need by providing a low-cost apparatus that makes it easy and convenient to clean dirt and corrosion from cylindrical female electrical terminals.

In accordance with an aspect of the invention, an apparatus for cleaning cylindrical female electrical terminals comprises a cylindrical shaft portion, a first cleaning extension, and a second cleaning extension. The first cleaning extension extends outward from the cylindrical shaft portion and comprises a first curved and knurled surface region. Likewise, the second cleaning extension extends outward from the cylindrical shaft portion in a direction substantially parallel to the first cleaning extension and comprises a second curved and knurled surface region. The first cleaning extension and the second cleaning extension define a gap therebetween.

In accordance with another aspect of the invention, the above-described apparatus further comprises a handle.

Moreover, in accordance with even another aspect of the invention, the apparatus comprises an elastic element disposed within the gap that is adapted to elastically bias the first cleaning extension away from the second cleaning extension.

In accordance with one of the above-identified embodiments of the invention, a hand tool for cleaning cylindrical female electrical terminals comprises a cleaning bit and a handle. The cleaning bit, in turn, comprises two mirror-image cleaning extensions that extend in a direction substantially parallel to one another from a cylindrical shaft portion. The two cleaning extensions are spaced apart and each terminates in a respective curved and knurled surface region. Within the gap between the cleaning elements is disposed an elastic element that is adapted to elastically bias one cleaning extension away from the other cleaning extension. When both cleaning extensions are simultaneously inserted into a cylindrical female electrical terminal, the curved and knurled surface regions of the cleaning extensions are forced against the inside surface of the cylindrical female electrical terminal with sufficient force to allow them to effectively scrape off any dirt or corrosion on that surface as the cleaning bit is moved.

Advantageously, this hand tool embodiment makes it easy and convenient to clean dirt and corrosion from cylindrical female electrical terminals on trailer connectors as well as other types of connectors so that these electrical terminals are reliably capable of forming low-resistance electrical connections.

BRIEF DESCRIPTION OF THE DRAWINGS

These and other features, aspects, and advantages of the present invention will become better understood with regard to the following description, appended claims, and accompanying drawings where:

DETAILED DESCRIPTION OF THE INVENTION

The present invention will be described with reference to illustrative embodiments. For this reason, numerous modifications can be made to these embodiments and the results will still come within the scope of the invention. No limitations with respect to the specific embodiments described herein are intended or should be inferred.

Figure 1A:
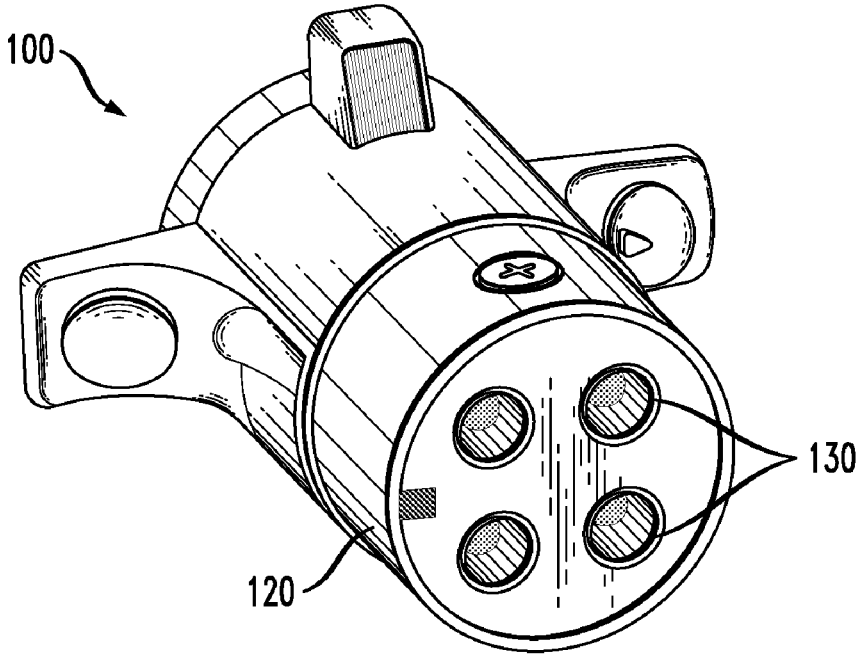
FIG. 1A shows a perspective view of an illustrative trailer connector.
Figure 1B:
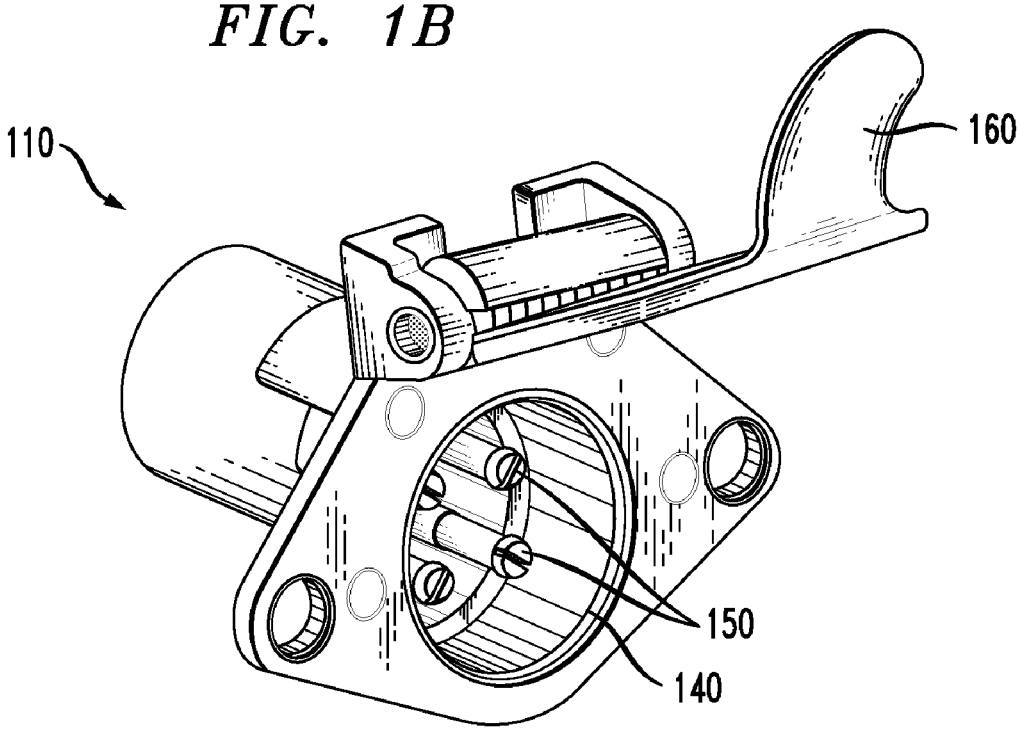
FIG. 1B shows a perspective view of an illustrative towing vehicle connector.
Figure 2:
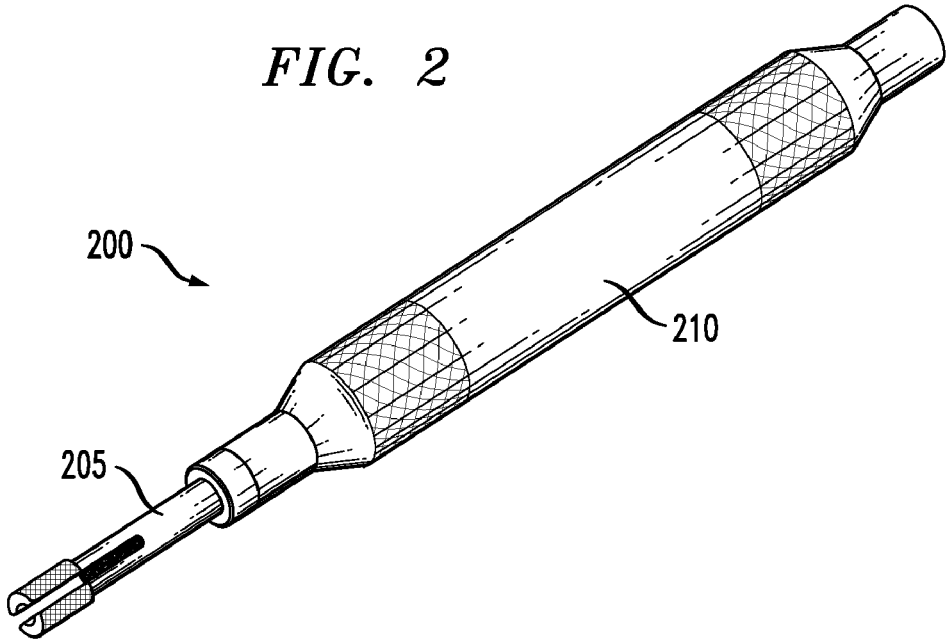
FIG. 2 shows a perspective view of an apparatus in accordance with an illustrative embodiment of the invention.

FIG. 2 shows a perspective view of an apparatus 200 in accordance with an illustrative embodiment of the invention. The apparatus is in the form of a hand tool having a cleaning bit 205 mounted onto a handle 210.

Figure 3A:
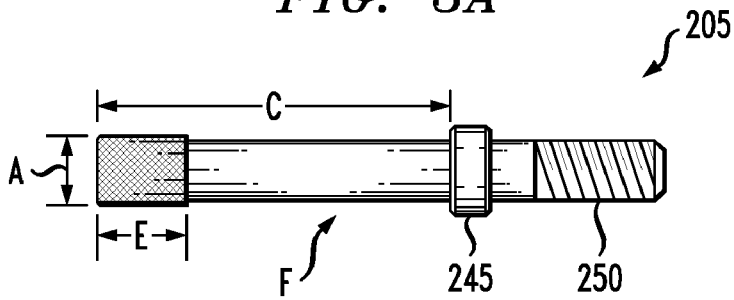
FIGS. 3A-3C show a top view, a side view, and an end view, respectively, of the cleaning bit in the FIG. 2 apparatus.
Figure 3C:
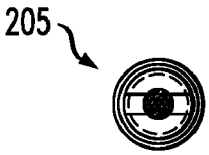
Figure 3B:
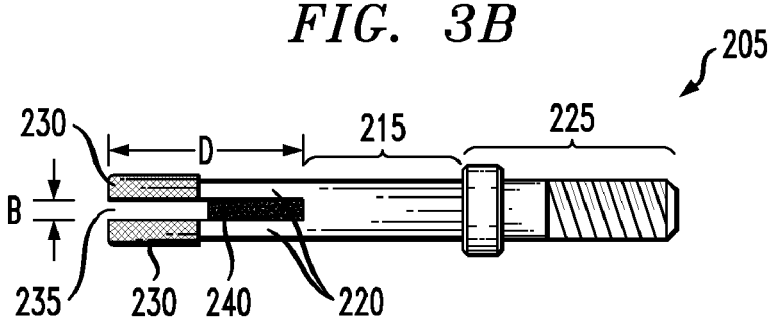

Additional details of the illustrative apparatus 200 may be seen in FIGS. 3A-3C and FIGS. 4A-4C. FIGS. 3A-3C show a top, side, and end view of the cleaning bit 205, respectively. The cleaning bit comprises a cylindrical shaft portion 215 that is connected to two cleaning extensions 220 at one end, and a mounting portion 225 at the other end. These elements preferably comprises steel such as cold rolled steel. The cleaning extensions extend outward from the cylindrical shaft portion in a direction substantially parallel to the long axis of the shaft. In fact, each cleaning extension is substantially a mirror image of the other cleaning extension. Each of the cleaning extensions terminates in a respective curved and knurled surface region 230.

As further indicated in the figures, the cleaning extensions 220 are spaced apart from each other, thereby forming a gap 235 therebetween. In accordance with an aspect of the invention, a cylindrical elastic element 240 is disposed within this gap in a somewhat compressed state. The cylindrical elastic element may, for example, comprise rubber. The compressed state of the cylindrical elastic element acts to elastically bias the cleaning extensions away from each other. Lateral movement of the cylindrical elastic element from the end-on perspective of FIG. 3C is restricted by a slight rounding of the surfaces of the cleaning extensions facing the gap. This slight rounding creates a small bulge in the gap in which the cylindrical elastic element is firmly seated.

The mounting portion 225 of the cleaning bit 205, in turn, comprises a locking ring portion 245 having a diameter somewhat larger than that of the cylindrical shaft portion 215. In addition, the mounting portion comprises a threaded cylindrical portion 250. The threaded cylindrical portion allows the cleaning bit to be mounted on the handle 210.

Figure 4A:
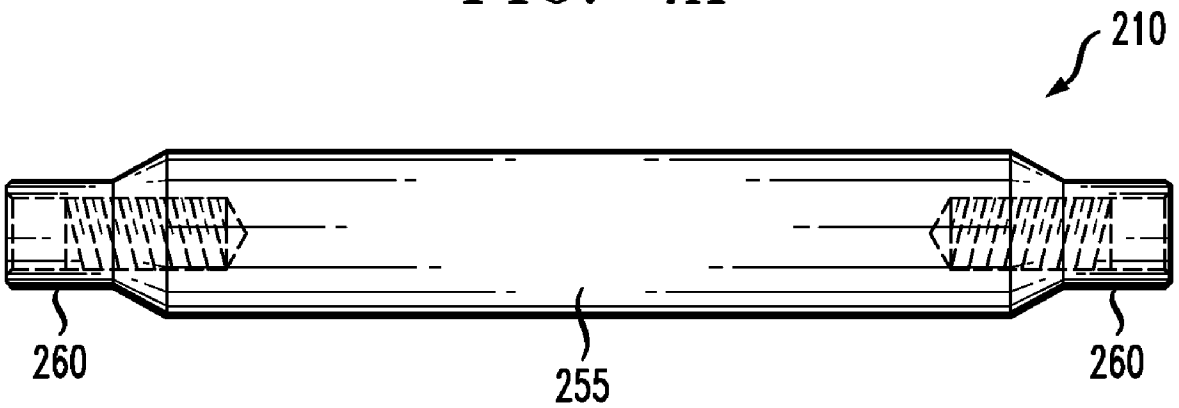
FIG. 4A-4C show a transparent side view, a side view, and an end view, respectively, of the handle in the FIG. 2 apparatus.
Figure 4B:
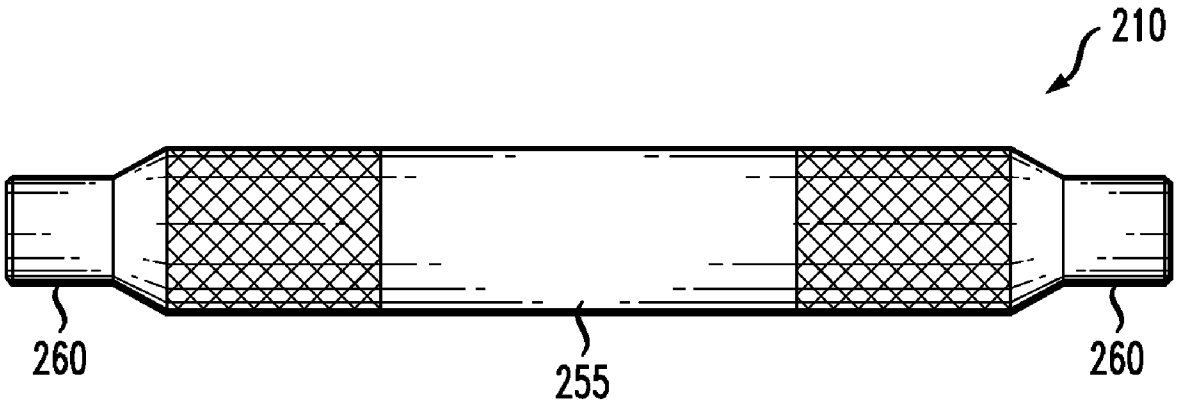
Figure 4C:
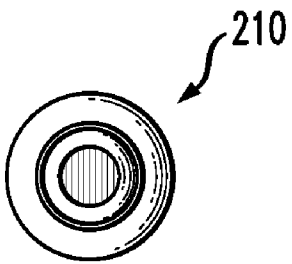

FIGS. 4A-4C show a transparent side view, a side view, and an end view, respectively, of the handle. The handle comprises a cylindrical handle portion 255 with two tapered ends 260. It may be formed of, as just one example, aluminum. Each tapered end is tapped (i.e., comprises internal screw threads) so that it can accommodate one cleaning bit. In this manner, a single handle can support two different cleaning bits if such an arrangement is desired. Portions of the handle are also knurled to provide a user with better purchase on the tool during use.

It is the curved and knurled surface regions 230 of the cleaning extensions 220 that are primarily tasked with cleaning the inside surface of a cylindrical female electrical terminal. The apparatus 200 is dimensioned such that simultaneously inserting both cleaning extensions into a cylindrical female electrical terminal causes the curved and knurled surface regions to contact the inner surface of that terminal while, at the same time, causing the cleaning extensions to bend somewhat toward each other (i.e., reduce the gap 235). The tendency of the material constituting the cleaning bit (e.g., steel) to resist such bending in combination with the elastic biasing provided by the cylindrical elastic element 215 resist this bending motion. The result is that the curved and knurled surface regions of the cleaning extensions are forced against the inside surface of the cylindrical female terminal with sufficient force to allow them to effectively scrape off any dirt or corrosion on that surface as the cleaning bit is moved.

If it is desired, for example, that the cleaning bit 205 be used to clean cylindrical female electrical terminals in accordance with standard "4-way," "5-way," and "6-way" trailer applications, the cleaning bit may be dimensioned such that (referring to the dimensions marked on FIGS. 3A and 3B):

A=0.18 inches length;
B=0.050 inches length;
C=1.0 inches length;
D=0.55 inches length;
E=0.25 inches length; and
F=0.16 inches diameter.

The cylindrical elastic element 240 may have a diameter slightly larger than the "B" when uncompressed (e.g., 0.060 inches) and have a length of about 0.25 inches. Of course, it is contemplated that dimensions substantially different from these will also be appropriate depending on the particular application (e.g., depending on the size of the cylindrical female electrical terminal).

Using the apparatus 200, the cleaning of a cylindrical female electrical terminal becomes the simple act of inserting the cleaning bit 205 into the terminal such that the curved and knurled surface regions 230 make contact with the inside surface of the terminal, and manually providing the cleaning bit with an inward-outward motion and/or twisting motion using the handle. The curved and knurled surface regions, in turn, scrape the inside surface of the cylindrical female electrical terminal and remove any dirt or corrosion thereon.

Nevertheless, it should again be emphasized that the above-described embodiment of the invention is intended to be illustrative only. Embodiments of the invention, for example, can be utilized to clean cylindrical female electrical terminals on any type of connector, not necessarily those associated with trailers or towing vehicles. Moreover, embodiments can use different elements, materials, and dimensions and still come within the scope of the invention. A cleaning bit in accordance with aspects of the invention may, as just another example, be adapted so that it can be chucked onto a power tool such as an electric hand drill. These numerous alternative embodiments within the scope of the appended claims will be apparent to one skilled in the art.

Finally, all the features disclosed herein may be replaced by alternative features serving the same, equivalent, or similar purpose, unless expressly stated otherwise. Thus, unless expressly stated otherwise, each feature disclosed is one example only of a generic series of equivalent or similar features.

What is claimed is:

1. An apparatus for cleaning cylindrical female electrical terminals, the apparatus comprising:

a cylindrical shaft portion;

a first cleaning extension extending outward from the cylindrical shaft portion, the first cleaning extension comprising a first curved and knurled surface region;

a second cleaning extension extending outward from the cylindrical shaft portion in a direction substantially parallel to the first cleaning extension, the second cleaning extension comprising a second curved and knurled surface region, and the first cleaning extension and the second cleaning extension defining a gap therebetween; and an elastic element disposed within the gap defined by the first and second cleaning extensions, the elastic element adapted to elastically bias the first cleaning extension away from the second cleaning extension.

2. The apparatus of claim 1, wherein the first and second cleaning extensions extend outward from the cylindrical shaft portion in a direction substantially parallel to a long axis of the cylindrical shaft portion.

3. The apparatus of claim 1, wherein the second cleaning extension is substantially a mirror image of the first cleaning extension.

4. The apparatus of claim 1, wherein the elastic element comprises rubber.

5. The apparatus of claim 1, wherein the elastic element is substantially cylindrical.

6. The apparatus of claim 1, further comprising a mounting portion attached to the cylindrical shaft portion, the mounting portion comprising a threaded cylindrical portion.

7. The apparatus of claim 1, further comprising a handle.

8. The apparatus of claim 7, wherein the handle comprises internal screw threads.

9. The apparatus of claim 1, wherein the apparatus comprises steel.

10. The apparatus of claim 1, wherein the apparatus comprises cold rolled steel.

11. The apparatus of claim 1, wherein the apparatus is adapted so that the first and second cleaning extensions can be simultaneously inserted into a cylindrical female electrical terminal such that the first and second curved and knurled surface regions come into contact with an inside surface of the cylindrical female electrical terminal.

12. The apparatus of claim 1, wherein the apparatus is in the form of a hand tool.

13. An apparatus for cleaning cylindrical female electrical terminals, the apparatus comprising:

a cylindrical shaft portion;

a first cleaning extension extending outward from the cylindrical shaft portion, the first cleaning extension comprising a first curved and knurled surface region;

a second cleaning extension extending outward from the cylindrical shaft portion in a direction substantially parallel to the first cleaning extension, the second cleaning extension comprising a second curved and knurled surface region, and the first cleaning extension and the second cleaning extension defining a gap therebetween;

a handle attached to the cylindrical shaft portion; and an elastic element disposed within the gap defined by the first and second cleaning extensions, the elastic element adapted to elastically bias the first cleaning extension away from the second cleaning extension.

14. The apparatus of claim 13, wherein the first and second cleaning extensions extend outward from the cylindrical shaft portion in a direction substantially parallel to a long axis of the cylindrical shaft portion.

15. The apparatus of claim 13, wherein the second cleaning extension is substantially a mirror image of the first cleaning extension.

16. The apparatus of claim 13, wherein the apparatus is in the form of a hand tool.

* * * * *